US009217986B2

(12) United States Patent
Shuhama et al.

(10) Patent No.: US 9,217,986 B2
(45) Date of Patent: Dec. 22, 2015

(54) IMAGE FORMING APPARATUS

(71) Applicant: CANON KABUSHIKI KAISHA, Tokyo (JP)

(72) Inventors: Yu Shuhama, Yokohama (JP); Yuichiro Osawa, Mishima (JP); Masao Amano, Susono (JP); Kiyoharu Yoshioka, Yokohama (JP); Nobukazu Adachi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/464,738

(22) Filed: Aug. 21, 2014

(65) Prior Publication Data

US 2014/0356022 A1 Dec. 4, 2014

Related U.S. Application Data

(62) Division of application No. 13/207,668, filed on Aug. 11, 2011, now Pat. No. 8,838,007.

(30) Foreign Application Priority Data

Aug. 20, 2010 (JP) ..... 2010-184653

(51) Int. Cl.
*G03G 15/00* (2006.01)
*G03G 21/16* (2006.01)

(52) U.S. Cl.
CPC .... *G03G 21/1633* (2013.01); *G03G 2221/1654* (2013.01); *G03G 2221/1672* (2013.01)

(58) Field of Classification Search
CPC ..... B41J 23/12; B41F 13/36; G03G 15/1605; G03G 21/1633; G03G 2221/1654; G03G 2221/1672
USPC ..... 399/121, 401, 380, 22, 23, 114, 394, 399/395, 124, 405; 400/691–693
See application file for complete search history.

(56) References Cited

U.S. PATENT DOCUMENTS

| | | | | |
|---|---|---|---|---|
| 4,947,208 | A | 8/1990 | Komatsu et al. | |
| 7,085,517 | B2 * | 8/2006 | Sameshima | 399/111 |
| 2008/0187343 | A1 * | 8/2008 | Yamaguchi et al. | 399/74 |
| 2008/0253802 | A1 | 10/2008 | Koyanagi et al. | |
| 2009/0129815 | A1 * | 5/2009 | Kouzu | 399/121 |

FOREIGN PATENT DOCUMENTS

| | | | |
|---|---|---|---|
| JP | 2000-079739 | A | 3/2000 |
| JP | 2004-189388 | A | 7/2004 |
| JP | 2009-202424 | A | 9/2009 |

* cited by examiner

*Primary Examiner* — Matthew G Marini
(74) *Attorney, Agent, or Firm* — Fitzpatrick, Cella, Harper & Scinto

(57) ABSTRACT

An image forming apparatus includes an image bearing member for bearing a toner image, a transfer member for transferring the toner image from the image bearing member onto a sheet in contact with the image bearing member, and an openable unit including an openable member and a rotational shaft. In addition, a lock member locks the openable unit in a closed state by movement of the openable member, and a cam member, provided in the main assembly, rotatably moves the transfer member toward and away from the image bearing member. A force receiving portion, provided on the openable unit, receives a reaction force in contact with the cam member. The openable member includes the transfer member, and the cam member urges the force receiving portion when rotated to impart a force, for attracting the openable unit toward a locking direction by the lock member, to the openable member.

15 Claims, 7 Drawing Sheets

(a)

(b)

(a)

(b)

(a)

(b)

IMAGE FORMING APPARATUS

This application is a divisional of application Ser. No. 13/207,668, filed Aug. 11, 2011.

FIELD OF THE INVENTION AND RELATED ART

The present invention relates to an image forming apparatus which employs an electrophotographic or electrostatic image forming system.

In the image forming apparatus such as a printer, a part of an outer casing cover constituting the image forming apparatus is rotatable as a contact (rotatable member) in order that a user removes a jammed sheet when the sheet to be conveyed is jammed or that the user replaces an exchanging unit such as a process cartridge or a transfer belt unit. By rotation of the openable cover, an opening is formed.

The openable cover is locked by a locking member in a closed state so as not to be inadvertently opened. In the case where the openable cover is large in size or the case where a force is exerted on the openable cover in a direction in which the openable cover is open, a plurality of locking members are provided in many cases in order to maintain a closed state of the openable cover with reliability.

Japanese Laid-Open Patent Application (JP-A) 2000-79739 discloses a constitution in which a locking member is provided, on an openable cover, at each of both end portions of a rotational shaft of the contact with respect to an axial direction.

However, in the case where the plurality of locking members are provided, in some cases, a part of the locking members locks the openable cover but a remaining part of the cam members does not lock the contact. For example, in the case where the user closes the openable cover relative to an apparatus main assembly (of the image forming apparatus) while holding one end of the openable cover, the locking member at a side where the user holds the openable cover can lock the openable cover but the locking member at the other side cannot lock the openable cover in some cases.

Thus, there arises a problem of a so-called "partly locking state" (one side locking) in which a part of the locking members locks the openable cover but a remaining part of the locking members does not lock the openable cover.

SUMMARY OF THE INVENTION

A principal object of the present invention is to provide an image forming apparatus capable of obviating partly locking state without adding a particular member even when the partly locking state is caused.

According to an aspect of the present invention, there is provided an image forming apparatus comprising:

an openable cover, including a rotational shaft, capable of opening and closing an opening by being rotated about the rotational shaft relative to a main assembly of the image forming apparatus;

an image forming portion for forming a toner image on a sheet;

an opposing member, provided in the image forming portion, opposing the openable cover when the openable cover closes the opening;

a contact member, provided on the openable cover, contactable to the opposing member;

an urging member, provided on the openable cover, for urging the contact member toward the opposing member; and a locking member for locking the openable cover in a closed state relative to the main assembly, wherein the image forming apparatus comprising a cam member, provided in the image forming portion, for moving the contact member toward and away from the opposing member by rotation of the cam member, and wherein the cam member has a shape such that when the contact member is contacted to the opposing member in a state in which the openable cover is not locked by the locking member, the cam member applies a force to the openable cover in a direction, in which the opening is open, by rotation thereof and then applies a force to the openable cover in a direction, in which the opening is closed, by rotation thereof.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a) and (b) of FIG. 1 are illustrations each showing rotation of a cam member and reaction force received by an openable member.

Parts (a) and (b) of FIG. 2 are illustrations each showing rotation of the cam member and reaction force received by the openable member.

Figure 5:
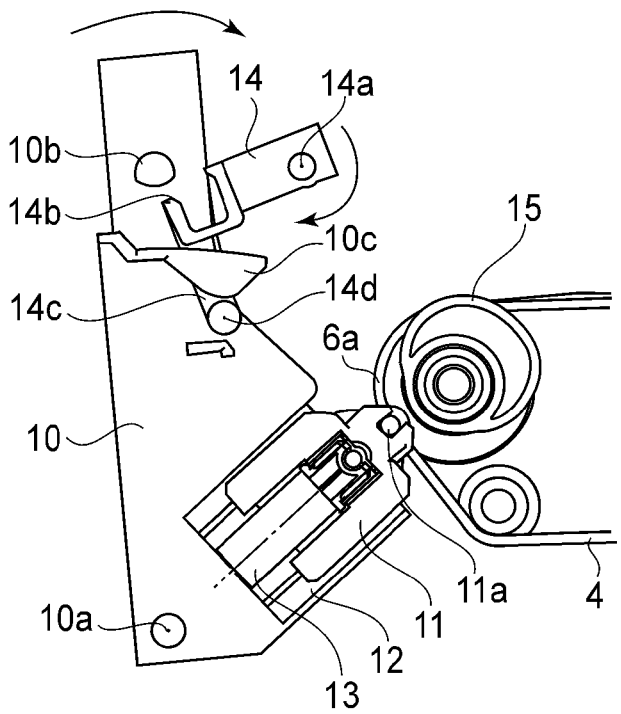
Figure 5:
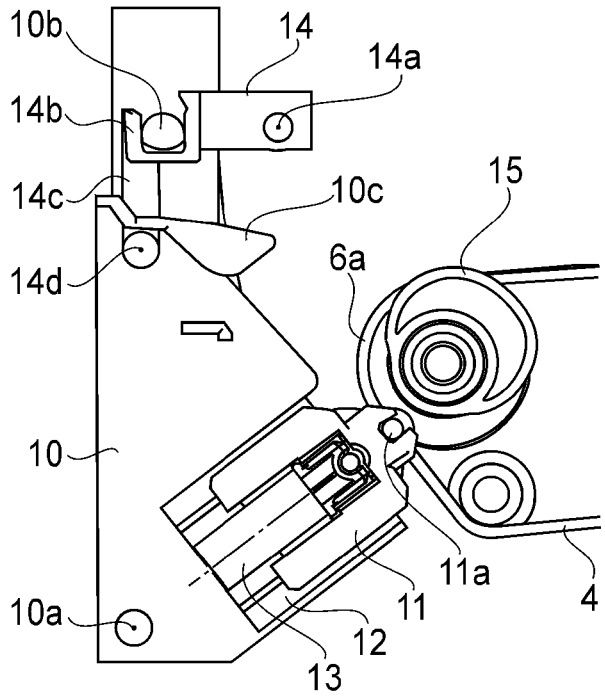

Parts (a) and (b) of FIG. 5 are illustrations each showing a locking mechanism.

Figure 6:
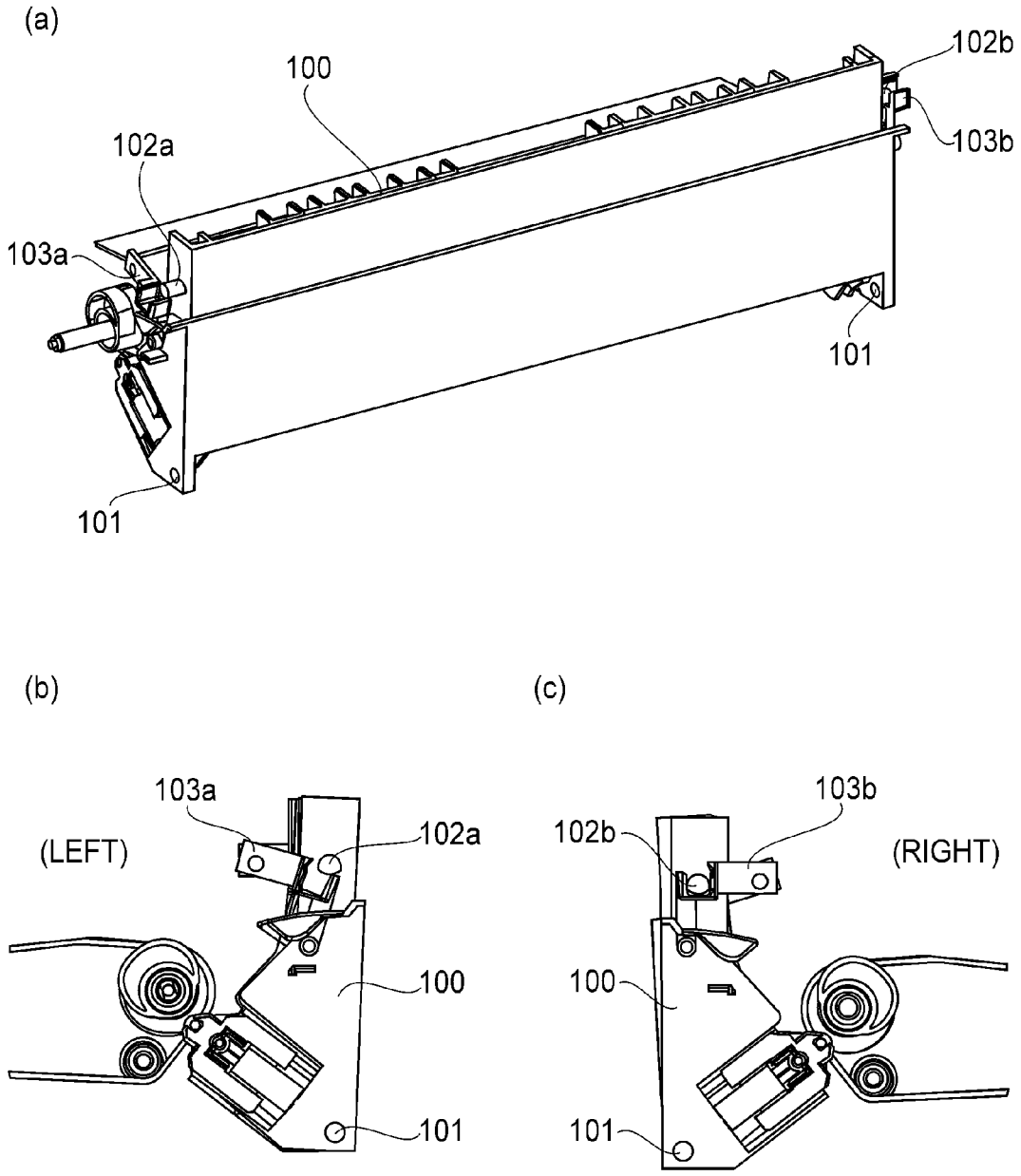

Parts (a), (b) and (c) of FIG. 6 are illustrations of a partly locking state.

Figure 7:
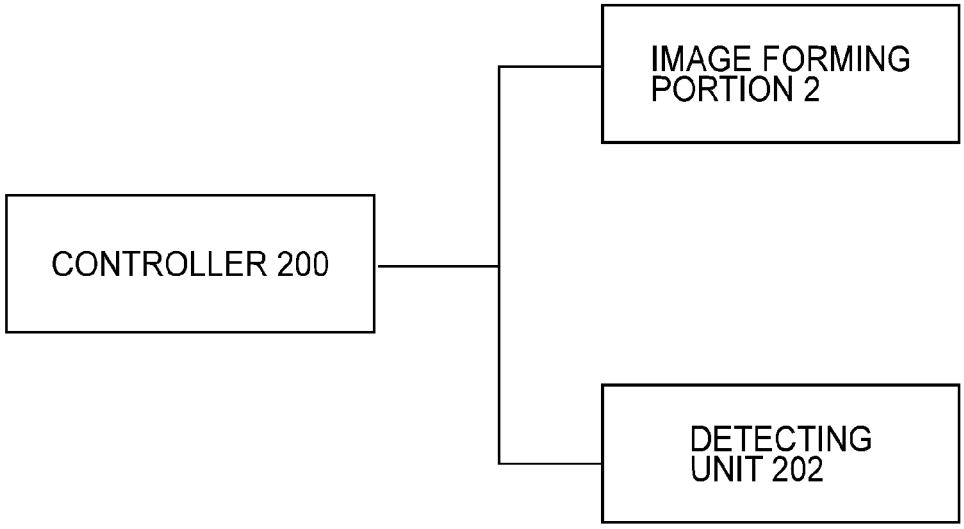

FIG. 7 is a block diagram for illustrating a relationship among a controller and associated portions.

DESCRIPTION OF THE PREFERRED EMBODIMENTS

The image forming apparatus according to the present invention will be described below more specifically with reference to the drawings. Dimensions, materials, shapes and relative arrangements of constituent parts or elements described in the following embodiments should be appropriately be changed depending on constitutions and various conditions of the image forming apparatus to which the present invention is applied, and the scope of the present invention is not limited to the following embodiments.

Embodiment 1

The image forming apparatus in this embodiment according to the present invention will be specifically described with reference to the drawings.

<General Structure of Image Forming Apparatus>

Figure 4:
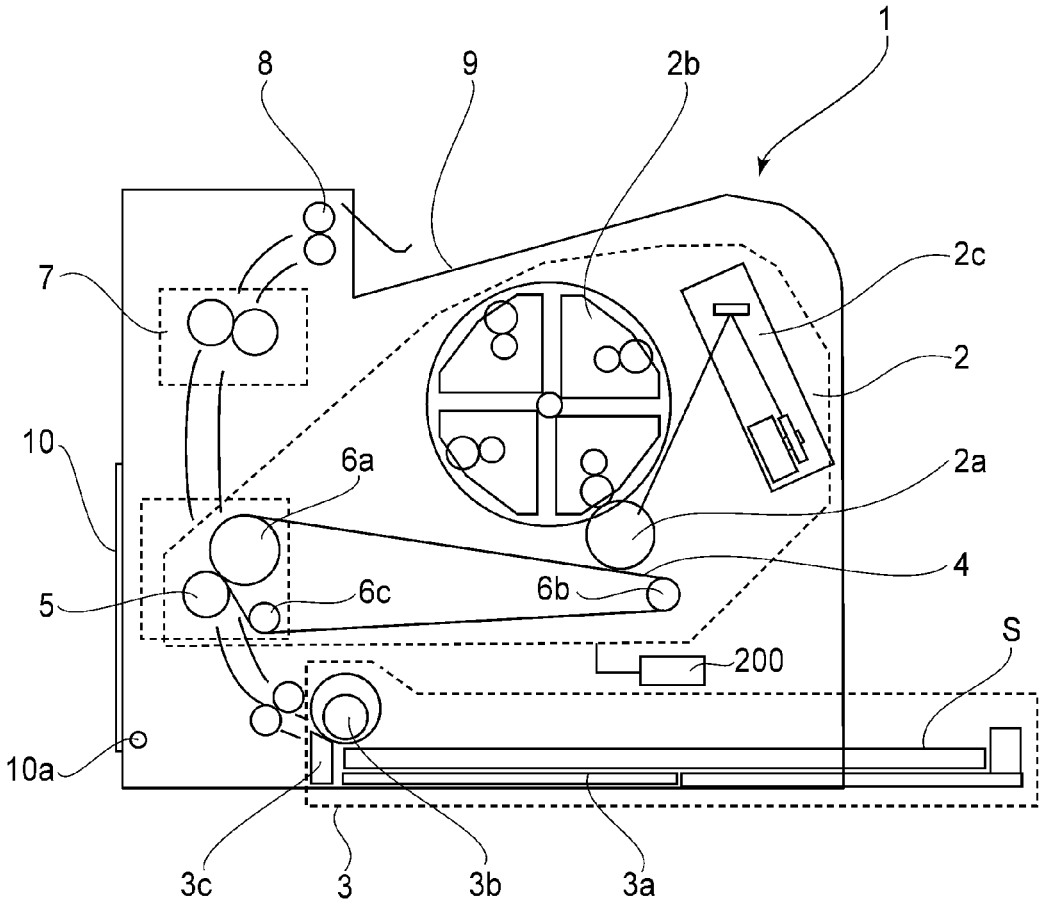
FIG. 4 is a schematic view for illustrating an image forming apparatus.

FIG. 4 is a schematic view showing a general structure of a laser printer which is an example of the image forming apparatus in this embodiment.

Referring to FIG. 4, an apparatus main assembly 1 of the image forming apparatus includes an image forming portion 2 and a sheet feeding device 3 for feeding sheets S to the image forming portion 2.

The image forming portion 2 includes a photosensitive drum 2*a*, a rotary developing device 2*b*, a laser exposure unit 2*c* and the like. The rotary developing device 2*b* includes a rotatable rotary and four developing device portions for yellow, magenta, cyan and black which are detachably mountable to the rotary and are provided integrally with associated toner cartridges, respectively. The rotary developing device 2*b* is rotated as necessary to move the developing device portion for a desired color to a developing position in which the developing device portion opposes the photosensitive drum 2*a* by rotation of the rotary developing device 2*b*.

The image forming portion 2 includes an endless intermediary transfer belt 4 which is an intermediary transfer member for primary-transferring, after forming and transferring four color toner images superposedly, multi-color toner images onto a sheet S and includes a secondary transfer roller 5 constituting a secondary transfer portion where the toner images from the intermediary transfer belt 4 onto the sheet. At a position in which the intermediary transfer belt opposes the photosensitive drum 2*a*, a primary transfer member (not shown) is provided. The primary transfer member is supplied with a voltage by a high voltage source (not shown), so that an electric field is formed between the primary transfer member and the photosensitive drum 2*a* to permit the primary transfer.

The intermediary transfer belt 4 is stretched by stretching rollers 6*a*, 6*b* and 6*c* and is rotatable in the clockwise direction in FIG. 4. The secondary transfer roller 5 as a secondary transfer member is disposed at a position in which the secondary transfer roller 5 opposes the stretching roller 6*a* which is one of the stretching rollers, and is urged by an urging member described later to be press-contacted to the intermediary transfer belt 4 supported by the stretching roller 6*a*. A nip between the intermediary transfer belt 4 and the secondary transfer roller 5 is the secondary transfer portion. When the sheet is conveyed in the nip, a secondary transfer bias is applied to the secondary transfer roller 5, so that the toner images are transferred from the intermediary transfer belt 4 onto the sheet S.

At a downstream side of the secondary transfer portion with respect to a sheet conveyance direction, a fixing portion 7 for fixing an unfixed toner image on the sheet, a discharging roller pair 8 for discharging the sheet S, on which the toner image is fixed to the outside of the apparatus main assembly 1, and the like are provided.

The sheet feeding device 3 includes a feeding cassette 3*a* provided at a lower portion of the apparatus main assembly 1 and a feeding roller 3*b* for feeding the sheet S accommodated in the feeding cassette 3*a*. Further, the sheet feeding device 3 includes a sheet separating portion constituted by a separating pad 3*c* for separating the sheet S fed by the feeding roller 3*b*. The sheet S is fed from the feeding cassette 3*a* toward the image forming portion 2 by the feeding roller 3*b* of the sheet feeding device 3.

Then, an image forming operation of the thus constituted image forming apparatus will be described. When an image forming signal is outputted from a controller 200 of the apparatus main assembly 1, a light image for a first color, converted into a light signal, from a laser exposure unit 2*c* is projected onto the photosensitive drum 2*a*. Incidentally, the surface of the photosensitive drum 2*a* is electrically charged in advance. By the projection of the light image, an electrostatic latent image is formed on the surface of the photosensitive drum 2*a*.

Next, by the developing device portion for the first color selected from the four developing device portions disposed in the rotary developing device 2*b*, the electrostatic latent image is developed, so that a toner image for the first color is formed on the photosensitive drum 2*a*. Thereafter, the toner image formed on the photosensitive drum 2*a* is transferred onto the intermediary transfer belt 4. Here, in the case of a color mode, the intermediary transfer belt 4 on which the toner image is transferred is further rotated so that a subsequent toner image formed on the photosensitive drum 2*a* is transferred onto the intermediary transfer belt 4. In this case, the rotary developing device 2*b* is rotated by 90 degrees so that the developing device portion for a subsequent designated color opposes the photosensitive drum 2*a* and prepares for development of a subsequent electrostatic latent image. Further, the photosensitive drum 2*a* after the primary transfer is, similarly as in the case of the first color, repetitively subjected to the latent image formation, the development and the primary transfer, so that the respective color toner images are successively superposed.

At this time, the secondary transfer roller 5 located at the secondary transfer portion is separated (spaced) from the intermediary transfer belt 4 by a constitution described later so as not to disturb the toner images formed on the intermediary transfer belt 4 until the four color toner images are completely transferred onto the intermediary transfer belt 4.

On the other hand, in parallel to such an image forming operation, the sheet S accommodated in the feeding cassette 3*a* is fed by the feeding roller 3*b* and is separated one by one by a sheet separating portion. Then, the separated sheet S is sent to the secondary transfer portion with timing which coincides with the toner images on the intermediary transfer belt 4.

Next, the sheet S sent to the secondary transfer portion is, after the toner images are transferred onto the sheet S by the secondary transfer roller 5 moved to a contact position with the intermediary transfer belt 4, conveyed to the fixing portion 7. Thereafter, the toner images are heated and pressed by the fixing portion 7, so that unfixed transfer images are permanently fixed on the sheet S. The sheet S on which the image is fixed is discharged on a discharge tray 9 located at an upper surface of the apparatus main assembly 1.

<Operable Member Locking Constitution>

The image forming apparatus in this embodiment is provided with an opening at an outer casing cover portion in the neighborhood of the secondary transfer portion so that the conveyed sheet can be removed from the apparatus main assembly when jam occurs. The opening is configured to be capable of being closed and opened by an openable cover (operable member) 10. The intermediary transfer belt 4 is provided in the image forming portion 2 and is an opposing member which opposes when the openable cover 10 closes the opening. The secondary transfer roller 5 is a contact member contactable to the opposing member.

The openable cover 10 is, as shown in FIG. 5, mounted to the apparatus main assembly 1 rotatably about a rotational shaft 10*a*. The secondary transfer roller 5 is provided on the contact 10. The secondary transfer roller 5 largely influences on image accuracy of image formation and therefore in a state in which the openable cover 10 is closed, there is a need to form the secondary transfer nip with reliability. For this purpose, a shaft of the secondary transfer roller 5 is rotatably supported by bearings at end portions thereof.

The bearings 11*a* are slidably mounted on a supporting portion 12 and are urged toward the stretching roller 6*a* (secondary transfer opposite roller) by an urging member 13 such as a compression spring. For this reason, the secondary transfer roller 5 is, in the closed state of the contact 10, press-contacted to the intermediary transfer belt 4 supported by the stretching roller 6*a*, thus being movable to the position in which the secondary transfer nip is formed with reliability.

Further, in the closed state, the openable cover 10 receives reaction force in an open direction by an urging force of the urging member 13, so that there is a need to lock the openable cover 10 to the apparatus main assembly 1 in the closed state with reliability. For that purpose, in this embodiment, two locking members 14 are provided at longitudinal end portions so that the openable cover 10 is locked by the locking members 14 at two positions at longitudinal end portions thereof.

Parts (a) and (b) of FIG. 5 each shows a locking constitution for the openable cover 10 by the locking member 14. In each of the figures, only one locking member 14 located at one longitudinal end side is shown but the other locking member 14 having the same constitution is provided symmetrically.

The locking member 14 is, as shown in (a) of FIG. 5, a member having a hook-shaped end portion. The locking member 14 is mounted in the apparatus main assembly 1 rotatably about a shaft 14*a* and is urged in an arrow direction (counterclockwise direction) indicated in (a) of FIG. 5 by an unshown urging member. On the other hand, the openable cover 10 is provided, at an opposing position in which the openable cover 10 opposes the locking member 14, with a locking projection 10*b* by which a hook portion 14*b* of the locking member 14 is to be locked.

Further, the openable cover 10 is provided, below the locking projection 10*b*, with a tapered portion 10*c* along which the locking member 14 is pushed down when the openable cover 10 is opened and closed. Further, the locking member 14 is provided with an arm portion 14*c* extended downwardly from the hook portion 14*b* and is provided with a projection 14*d* engageable with the tapered portion 10*c* at an end of the arm portion 14*c*.

When the openable cover 10 is closed, as shown in (a) of FIG. 5, the tapered portion 10*c* is engaged with the projection 14*d* to push down the locking member 14. When the openable cover 10 is further pushed in, as shown in (b) of FIG. 5, the engagement between the tapered portion 10*c* and the projection 14*d* is released, so that the locking member 14 is raised and the hook portion 14*b* is locked by the locking projection 10*b*. Thus, the openable cover 10 is locked.

Also at a longitudinal opposite side, the similar locking member 14 is provided and therefore when the openable cover 10 is closed, the openable cover 10 is locked by the locking members 14 at the longitudinal end sides thereof.

In the image forming apparatus in this embodiment, an opening and closing detecting sensor 202 as a detecting unit for detecting an opening and closing state of the contact 10 is provided. When this opening and closing detecting sensor 202 detects a state in which the openable cover 10 is opened, the controller 200 stops an operation of the image forming apparatus 1.

Herein, such a function that the opening and closing detecting sensor 202 detects the open state of the openable cover 10 and then the controller 200 stops the operation of the image forming apparatus 1 on the basis of a detection result of the opening and closing detecting sensor 202 is referred to as interlocking function.

As described above, the openable cover 10 is locked at the two positions by the locking members 14. For this reason, in the case where the user closes the contact 10 by holding one longitudinal end of the openable cover 10, the contact 10 can be placed in the partly locking state in which the openable cover 10 is locked by only the one side locking member.

Parts (a), (b) and (c) of FIG. 6 are schematic views for illustrating the partly locking state, wherein (a) is a perspective view, (b) is a left side view of (a), and (c) is a right side view of (a). With reference to FIG. 6, the partly locking state is described by using an openable cover 100, locking projections 102*a* and 102*b*, locking members 103*a* and 103*b* and a rotational center 101.

The openable cover 100 extends in the horizontal direction along its longitudinal direction and is rotated about the rotational center 101 to close and open the opening. Further, the openable cover 100 is provided with the locking projections 102*a* and 102*b* at its longitudinal ends. On the other hand, the apparatus main assembly is provided with the locking members 103*a* and 103*b* at positions in which they oppose the locking projections 102*a* and 102*b*, respectively. When the openable cover 100 is closed, the left and right locking projections 102 and 102*b* are locked by the locking members 103*a* and 103*b*, respectively.

In a constitution including the plurality of the locking members 103*a* and 103*b*, in the case where, e.g., the user intends to close the openable cover 100 by pushing a right side of the openable cover 100 shown in (a) of FIG. 6, the partly locking state can be formed. Specifically, the openable cover 100 extends in a left-right direction and therefore rigidity thereof becomes insufficient, so that the right-sided locking member 103*b* and locking projection 102*b* are locked to be placed in a locked state but the left-sided locking member 103*a* and locking projection 102*b* are not locked as shown in (b) and (c) of FIG. 6, thus resulting in the partly locking state. Also in the case where the user pushes the left side of the openable cover 100 to close the openable cover 100, there is a possibility that the partly locking state in which the right-sided locking member and locking projection are not locked similarly. The partly locking state is formed in the above manner.

Under cost and space constraints, the opening and closing detecting sensor 202 is provided only at one position for the openable cover 10 (100) and therefore whether the openable cover 10 (100) is completely closed or is in the partly locking state cannot be detected. For example, even in a state in which the locking member 14 locks the locking projection of the openable cover 10 at the side where the opening and closing detecting sensor 202 is provided, it would be considered that the locking member 14 does not lock the locking projection of the contact 10 at the side where the opening and closing detecting sensor 202 is not provided. In this case, the opening and closing detecting sensor 202 detects that the openable cover 10 is locked but the openable cover 10 is actually in the partly locking state.

FIG. 7 is a block diagram for illustrating a relationship among the image forming portion 2, the controller 200 and the opening and closing detecting sensor 202. As described above, the controller 200 receives a detection result of the opening and closing detecting sensor 202 and can control the image forming portion 2.

In this embodiment, the partly locking state is prevented with reliability by using a contact and separation mechanism of the secondary transfer roller 5 relative to the intermediary transfer belt 4.

<Relationship Between Contact and Separation Mechanism and Locking Mechanism>

Here, a relationship between the contact and separation mechanism of the secondary transfer roller 5 relative to the intermediary transfer belt 4 and the locking mechanism of the openable cover 10 will be described.

As described above, the secondary transfer roller 5 is, when the color image is formed, separated or spaced from the intermediary transfer belt 4 until the four color toner images are completely transferred on the intermediary transfer belt 4. For this purpose, as the contact and separation mechanism for moving the secondary transfer roller 5 toward and away from the intermediary transfer belt 4, the cam member 15 is mounted so as to be rotated about the rotational shaft of the stretching roller 6*a* by a driving force from an unshown motor. This cam member 15 is an eccentric cam and is contacted to and separated from the bearing 11, which supports the longitudinal end of the secondary transfer roller 5 provided on the openable cover 10, by being rotated. Incidentally, the bearing 11 is contacted to the cam member 15 and is provided with a roller 11*a* at a force receiving portion at which reaction force is received. This roller 11*a* performs the function of reducing a sliding resistance with the cam member 15.

During the contact and separation operation of the secondary transfer roller 5, the cam member 15 is rotated to push in the bearing 11 thereof urged by the urging member 13, so that the secondary transfer roller 5 is separated from the intermediary transfer belt 4. When the cam member 15 is not contacted to the roller 11*a*, the secondary transfer roller 5 is press-contacted to the intermediary transfer belt 4 by the urging force of the urging member 13 to form the secondary transfer nip.

Further, in this embodiment, when the cam member 15 is rotated, the cam member 15 urges the secondary transfer roller 5 via the bearing 11 so as to impart a force in a direction in which the openable cover 10 is locked by the locking member 14. This constitution will be described.

Figure 1:
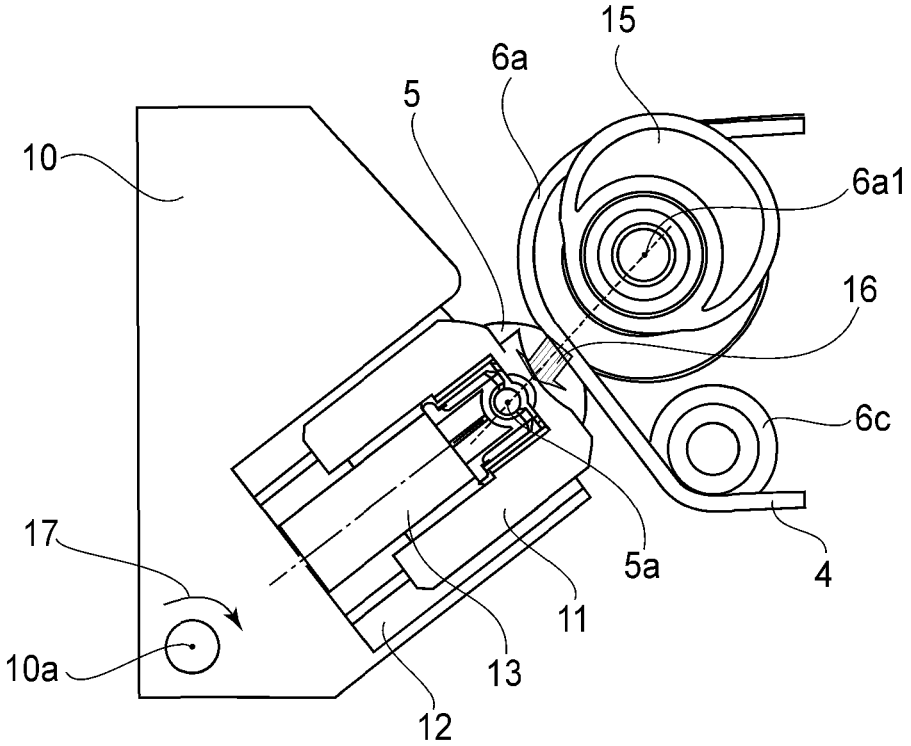
Figure 1:
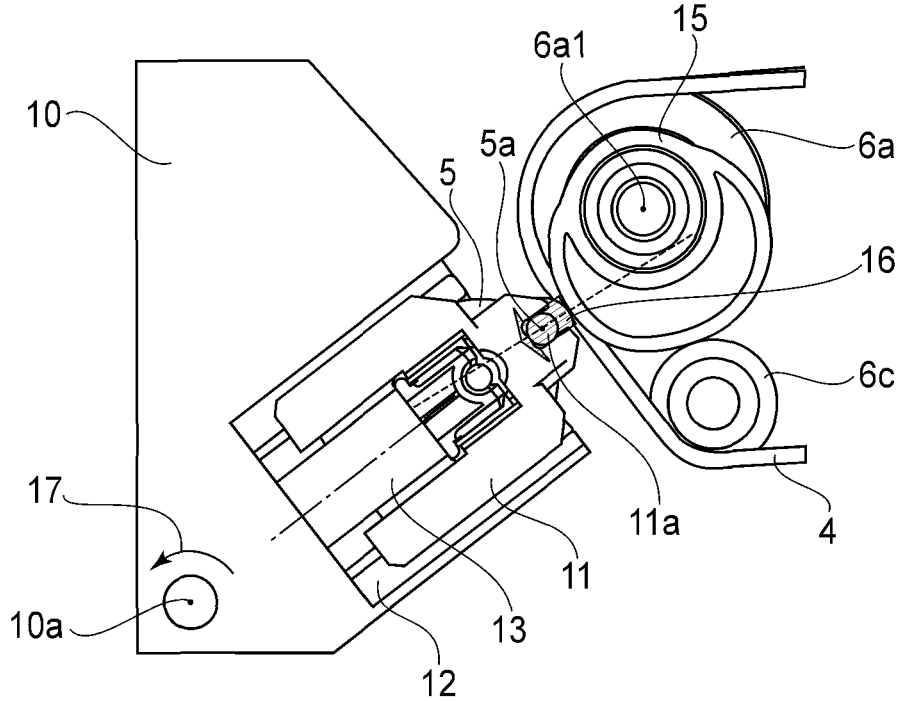

As shown in (a) of FIG. 1, in the case where the secondary transfer roller 5 is contacted to the intermediary transfer belt 4, the openable cover 10 receives reaction force 16 of the urging member 13 in a direction of a line segment connecting a rotational shaft 5*a* of the secondary transfer roller 5 and a rotational center 6*a*1 of the secondary transfer opposite roller 6*a* which supports the intermediary transfer belt 4. This direction is directed toward below the rotational shaft 10*a* of the openable cover 10, so that moment 17 in the clockwise direction, i.e., the closing direction acts on the openable cover 10 with the rotational shaft 10*a* as the center.

Next, as shown in (b) of FIG. 1, when the cam member 15 is rotated in the clockwise direction to the roller 11*a*, depending on an angle of the contact between the roller 11*a* and the cam member 15, the openable cover 10 receives the reaction force 16. When the direction of the reaction force 16 at that time is directed toward above the rotational shaft 10*a*, the moment 17 in the counterclockwise direction, i.e., the open direction acts on the openable cover 10.

At this time, in the case where the contact 10 is in the partly locking state, the force in the open direction acts on the openable cover 10 and therefore the openable cover 10 is open at the side where the openable cover 10 is not completely locked by the locking member 14 in some instances.

Figure 2:
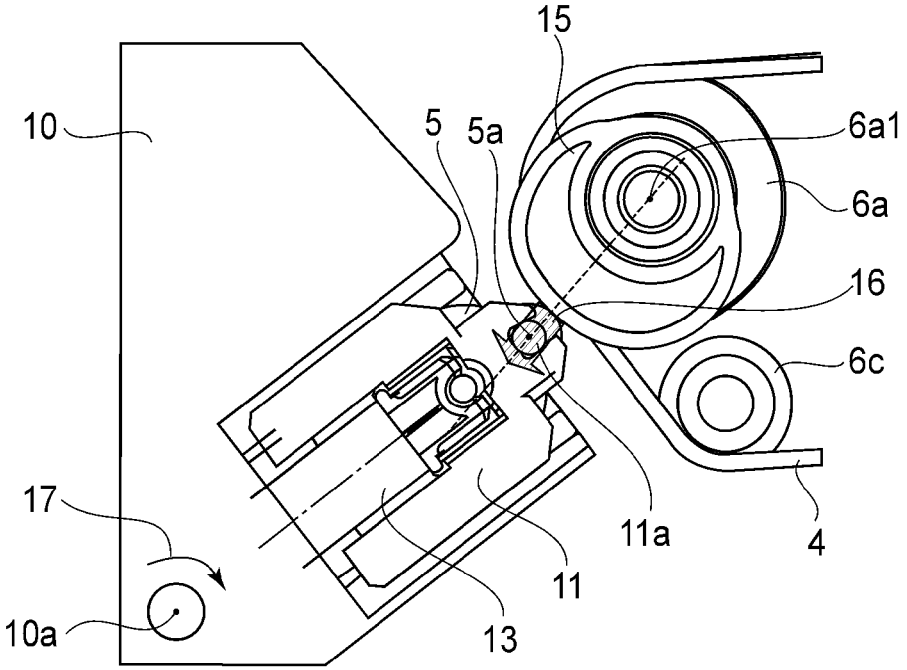
Figure 2:
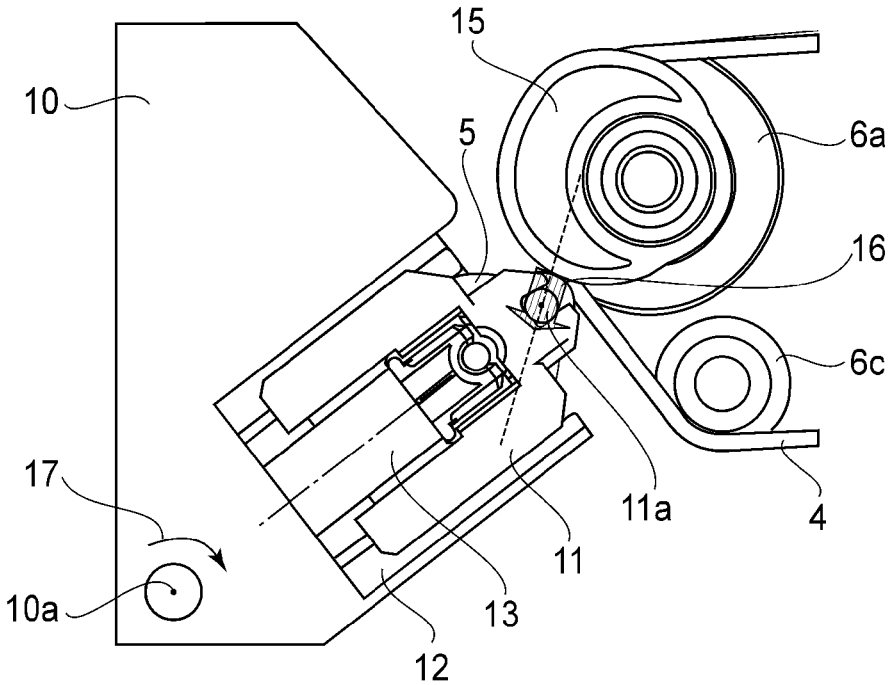

When the cam member 15 is further rotated and as shown in (a) of FIG. 2, in a state in which the secondary transfer roller 5 is completely separated from the intermediary transfer belt 4, the moment 17 in the closing direction acts on the contact 10. This is because the secondary transfer roller 5 is disposed so as to be somewhat deviated downwardly from the stretching roller 6*a* and thus a direction of a phantom line connecting the rotational shaft (center) 6*a*1 of the stretching roller 6*a* and the rotational shaft (center) 5*a* of the secondary transfer roller 5 is below the rotational shaft 10*a* of the openable cover 10.

When the cam member 15 is further rotated and as shown in (b) of FIG. 2, the secondary transfer roller 5 approaches the intermediary transfer belt 4, based on the contact angle between the roller 11*a* and the cam member 15, the openable cover 10 receives the reaction force 16 in the closing direction. When the cam member 15 reaches the position shown in (b) of FIG. 2, the moment 17 in the openable cover 10 closing direction becomes maximum. In this embodiment, this force in the openable cover 10 closing direction is sufficiently larger than a force required to urge the openable cover 10 toward the locking member 14 to lock the openable cover 10 by the locking member 14.

As described above, in this embodiment, when the cam member 15 for moving the secondary transfer roller 5 toward and away from the intermediary transfer belt 4 is rotated to perform the contact and separation operation of the secondary transfer roller 5, the direction and magnitude of the reaction force against the openable cover 10 are changed. Further, the cam member 15, the secondary transfer roller 5 and the rotational shaft 10*a* are disposed so that the openable cover 10 can receive a force, by the reaction force, required to be locked by the locking member 14. Thus, the openable cover 10 is locked by the left and right locking members 14 with reliability even in the partly locking state.

Figure 3:
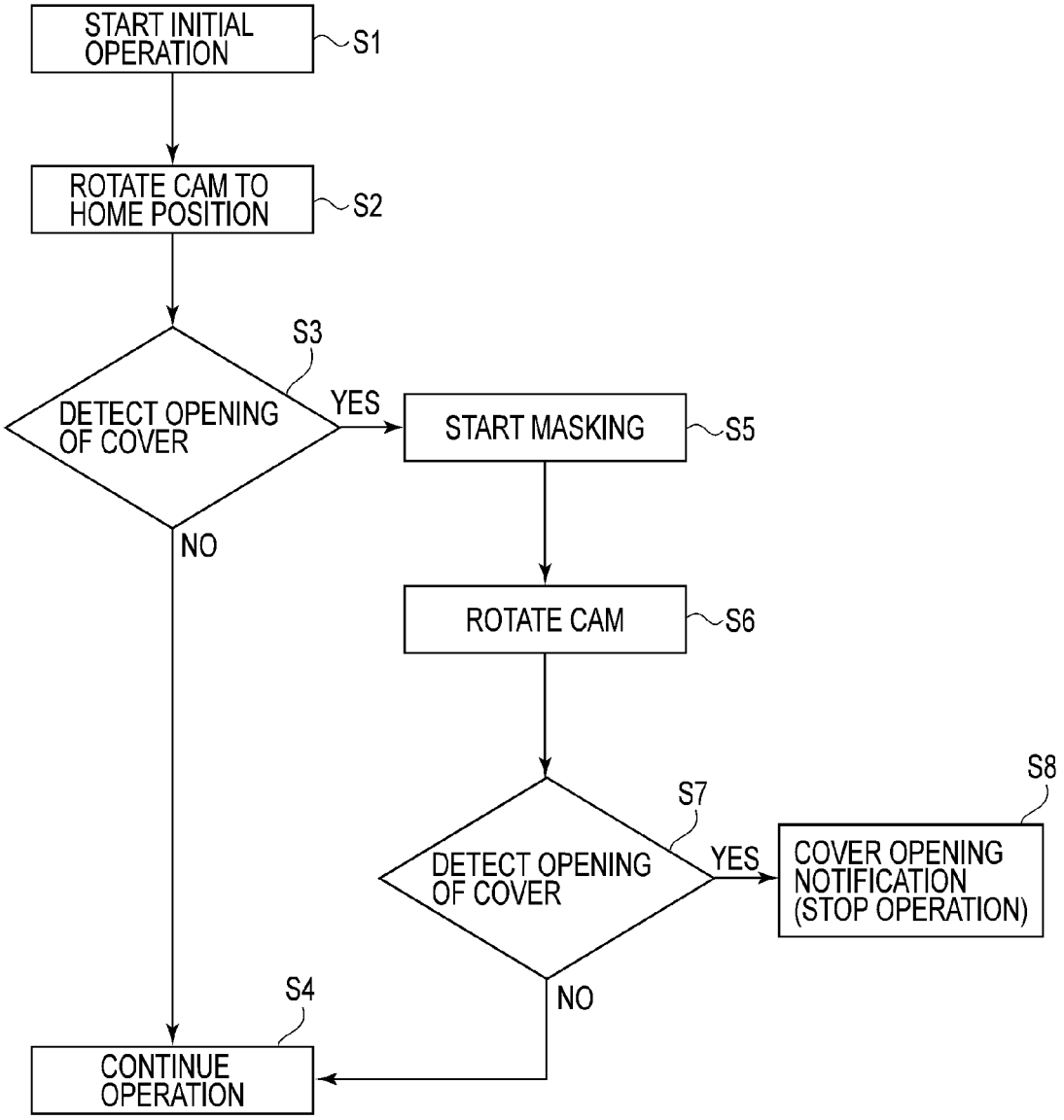
FIG. 3 is a flow chart of an initial operation.

Next, a partly locking state preventing sequence, of the openable cover 10, using the contact and separation operation of the secondary transfer roller 5 will be described with reference to FIG. 3.

In the case where the opening and closing detecting sensor 202 detects that the opened openable cover 10 after completion of jam clearance or the like is closed, an initial operation for returning the cam member 15 to a home position (initial position) is performed. The openable cover 10 can be forcedly opened at any time by the user for the jam clearance or the like. When the openable cover 10 is opened, the opening and closing detecting sensor 202 detects the open state of the contact 10, so that the interlocking function is performed and the controller 200 stops all the operations of the image forming apparatus. For this reason, the cam member 15 can be stopped at a position other than the home position, thus being required to be returned to the home position.

For this reason, when the opening and closing detecting sensor 202 detects that the openable cover 10 is closed, the initial operation for returning the cam member 15 to the home position is always performed before the image formation. The image forming apparatus in this embodiment can restore the openable cover 10 from the partly locking state to a normal state even when the openable cover 10 is in the partly locking state.

When the opening and closing detecting sensor 202 detects that the openable cover 11 is closed, the initial operation for returning the contact 11 to the home position is performed after the cam member 15 is rotated at least one full turn (S1, S2). At this time, the opening and closing detecting sensor 202 detects whether or not the openable cover 10 is open (S3).

When the openable cover 10 is reliably locked by the locking members 14, the opening and closing detecting sensor 202 does not detect, during the initial operation, that the openable cover 10 is opened. For this reason, the openable cover 10 is judged as being firmly closed, so that the image forming apparatus is placed in a print job waiting state as it is (S4).

On the other hand, although the openable cover 10 is in the partly locking state, when the opening and closing detecting sensor 202 detects that the openable cover 10 is closed, the initial operation is started similarly as in a normal operation since there is a possibility that the openable cover 10 is in the partly locking state. However, in this case, when the cam member 15 is rotated, as described above, there is the position in which the force in the open direction is exerted on the openable cover 10 and at that time, the opening and closing detecting sensor 202 detects that the openable cover 11 is opened in some cases. However, in the case where the openable cover 11 is in the partly locking state, the cam member 15 is further rotated and thus it is possible to attract the openable cover 10 to the locking member 14. For this reason, even in the case where the opening and closing detecting sensor 202 detects the open state, the cam member 15 is rotated as it is without terminating the operation to continue the initial operation (S5, S6). That is, when the cam member 15 is rotated during the initial operation, even in the case where the opening and closing detecting sensor 202 detects the open state, the control is effected so as not to stop the operation of the image forming apparatus.

After the rotation of the cam member 15 is ended, the opening and closing detecting sensor 202 detects whether or not the contact 10 is closed (S7). When the opening and closing detecting sensor 202 detects that the openable cover 10 is closed, the image forming apparatus is placed in the print job waiting state (S4).

As the case where the opening and closing detecting sensor 202 detects that the openable cover 10 is opened even after the end of the initial operation, it would be considered that the user pushes, when the opening and closing detecting sensor 202 first detects the closed state, the openable cover 10 toward the left and right locking members 14 in a partly urged state or that the openable cover 10 cannot be restored from the partly locking state due to the presence of something in the opening (erroneous detection). In this case, the user is notified of the open state of the contact 10 and the opening and closing detecting sensor 202 functions as the interlocking mechanism, so that all the operations of the image forming portion 2 are stopped (S8).

Thereafter, when the user closes the openable cover 10 again, a similar initial operation is performed to place the image forming apparatus in the job waiting state.

As described above, in this embodiment, it is possible to place the openable cover 10 in the locked state, even when the contact 10 is in the partly locking state, by the arrangement of the parts (members) and the initial sequence without adding a new member, with the use of the cam member 15 for moving the secondary transfer roller 5 toward and away from the intermediary transfer belt 4.

In the above description, as a pressing member for receiving the reaction force from the cam member, an example in which the secondary transfer roller 5 is provided on the openable cover 10 is shown. However, the example is not limited thereto but may also be, e.g., a constitution in which an intermediate feeding plate is raised and lowered by an openable cover for multi-feeding type, so long as the openable cover includes the pressing member which receives the reaction force by the rotation of the cam member.

Further, in this embodiment, the two locking members 14 are provided at the longitudinal end portions of the openable cover 10. However, the number of the locking members 14 is not limited to two but even when three or more locking members are employed, the partly locking state can be prevented or obviated by the above-described constitution.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 184653/2010 filed Aug. 20, 2010, which is hereby incorporated by reference.

What is claimed is:

1. An image forming apparatus comprising:

an image bearing member for bearing a toner image;

a transfer member for transferring the toner image from said image bearing member onto a sheet in contact with said image bearing member;

an openable unit, including a locking portion capable of opening and closing by being rotated relative to a main assembly of said image forming apparatus;

a lock member for locking said openable unit to the main assembly in a closed state by being engaged with said locking portion;

a rotatable cam member, provided in the main assembly, configured to move said transfer member toward and away from said image bearing member;

a force receiving portion, provided on said openable unit and capable of receiving a reaction force, in contact with said cam member;

wherein when said cam member in a position spaced from said force receiving portion starts rotation thereof, said force receiving portion receives a first force for moving said locking portion away from said lock member in a state in which said cam member starts contact with said force receiving portion and receives a second force for moving said locking portion toward said lock member by further rotation of said cam member.

2. An apparatus according to claim 1, further comprising, a detecting unit, at one longitudinal end portion of said openable unit, for detecting an opening and closing state of said openable unit, and a controller for controlling rotation of said cam member, wherein said controller is capable of executing an initial operation for moving a position of said cam member to an initial position and, when said detecting unit detects the opening state in which said openable member is open relative to the main assembly, rotates said cam member to move said transfer member in a direction in which said transfer member is spaced from said image bearing member.

3. An apparatus according to claim 2, wherein said controller rotates said cam member at least once by the initial operation when said detecting unit detects the opening state in which said openable unit is open relative to the main assembly.

4. An apparatus according to claim 2, wherein said controller stops said main assembly when said detecting unit detects opening of said openable unit after a rotating operation of said cam member is ended.

5. An apparatus according to claim 1, wherein said lock member is provided at least at each of longitudinal end portions of said openable unit.

6. An apparatus according to claim 1, wherein said image bearing member is an intermediary transfer member onto which the toner image is transferred.

7. An apparatus according to claim 6, wherein said transfer member is a secondary transfer roller for secondary-transferring the toner image from said intermediary transfer member onto the sheet.

8. An apparatus according to claim 7, further comprising a stretching roller for stretching said intermediary transfer member, wherein said cam member rotates about a rotation shaft of said stretching roller.

9. An image forming apparatus comprising:

an image bearing member for bearing a toner image;

a transfer member for transferring the toner image from said image bearing member onto a sheet in contact with said image bearing member;

an openable unit, including a rotational axis and locking portions provided in end sides, respectively, with respect to a rotational axis direction, capable of opening and closing by being rotated about the rotational axis, relative to a main assembly of said image forming apparatus;

lock members, provided in end sides, respectively, with respect to the rotational axis direction, for locking said openable unit to the main assembly in a closed state by being engaged with associated locking portions, respectively;

a rotatable cam member, provided in the main assembly, configured to move said transfer member toward and away from said image bearing member;

a force receiving portion, provided on said openable unit and capable of receiving a reaction force, in contact with said cam member;

wherein when said cam member in a position spaced from said force receiving portion starts rotation thereof in a state in which the locking portion in one end side engages with the lock member in one end side with respect to the rotational axis direction and in which the locking portion in the other end side does not engage with the lock member in the other end side with respect to the rotational axis direction, said openable unit moves in a direction in which the locking portion in the other end side moves away from the lock member in the other end side by contact of said cam member with said force receiving portion and then moves in a direction in which the locking portion in the other end side moves toward the lock member in the other end side by rotation of said cam member.

10. An apparatus according to claim 9, further comprising, a detecting unit, at one longitudinal end portion of said openable unit, for detecting an opening and closing state of said openable unit, and a controller for controlling rotation of said cam member, wherein said controller is capable of executing an initial operation for moving a position of said cam member to an initial position and, when said detecting unit detects the opening state in which said openable unit is open relative to the main assembly, rotates said cam member to move said transfer member in a direction in which said transfer member is spaced from said image bearing member.

11. An apparatus according to claim 10, wherein said controller rotates said cam member at least once by the initial operation when said detecting unit detects the opening state in which said openable unit is open relative to the main assembly.

12. An apparatus according to claim 11, wherein said controller stops said main assembly when said detecting unit detects opening of said openable unit after a rotating operation of said cam member is ended.

13. An apparatus according to claim 9, wherein said image bearing member is an intermediary transfer member onto which the toner image is transferred.

14. An apparatus according to claim 13, wherein said transfer member is a secondary transfer roller for secondary-transferring the toner image from said intermediary transfer member onto the sheet.

15. An apparatus according to claim 13, further comprising a stretching roller for stretching said intermediary transfer member, wherein said cam member rotates about a rotation shaft of said stretching roller.

* * * * *